United States Patent [19]

Kim

[11] Patent Number: 4,940,350

[45] Date of Patent: Jul. 10, 1990

[54] FLUID BALL APPLICATOR WITH VENT TUBE

[76] Inventor: Yong I. Kim, 3043 Wolverine Dr., Ann Arbor, Mich. 48108

[21] Appl. No.: 292,323

[22] Filed: Dec. 30, 1988

[51] Int. Cl.[5] ..... B43K 7/10; A45D 34/04

[52] U.S. Cl. ..... 401/209; 401/211; 401/215; 401/216; 401/217; 401/219

[58] Field of Search ..... 401/209, 211, 213, 215, 401/216, 217, 219

[56] References Cited

U.S. PATENT DOCUMENTS

| | | | |
|---|---|---|---|
| 436,822 | 9/1890 | Booraem . | |
| 527,049 | 10/1894 | Close . | |
| 812,087 | 2/1906 | Peterson . | |
| 1,032,512 | 7/1912 | Sloss . | |
| 1,179,080 | 4/1916 | Davis . | |
| 1,714,030 | 5/1929 | LeBoeuf | 401/213 X |
| 2,528,612 | 11/1950 | Schildkraut et al. | 132/79 |
| 2,564,842 | 8/1951 | Helmuth | 91/54.4 |
| 2,646,776 | 7/1953 | Scholz | 401/211 |
| 2,716,250 | 8/1955 | Deakers | 15/134 |
| 2,719,997 | 10/1955 | Ackerman | 401/213 |
| 2,841,809 | 7/1958 | Oliver | 15/138 |
| 3,010,139 | 11/1961 | Parker | 401/215 |
| 3,261,515 | 7/1966 | Luedtke | 222/520 |
| 4,050,826 | 9/1977 | Berghahn et al. | 401/196 |
| 4,571,769 | 2/1986 | Ford | 15/230.11 |
| 4,588,319 | 5/1986 | Niemeyer | 401/205 |
| 4,589,950 | 5/1986 | Sekavec, Jr. | 156/578 |
| 4,659,243 | 4/1987 | Winson | 401/197 |

FOREIGN PATENT DOCUMENTS

| | | | |
|---|---|---|---|
| 1511352 | 4/1969 | Fed. Rep. of Germany | 401/216 |
| 1004390 | 3/1952 | France | 401/209 |
| 403555 | 6/1966 | Switzerland | 401/216 |
| 1234228 | 5/1986 | U.S.S.R. | 401/216 |

*Primary Examiner*—Steven A. Bratlie
*Attorney, Agent, or Firm*—Basile and Hanlon

[57] ABSTRACT

A fluid applicator includes a fluid container having a collar mounted at an open top end. A base is mounted in the collar and is shaped to conform to the shape of a porous, spherical applicator member rotatably mounted in the collar, with a portion of the applicator member extending outward from the collar. An air intake conduit is centrally mounted in the base and draws air from the pores in the applicator member into the interior of the container to control the rate of fluid dispersion through fluid outlets formed in the base to the applicator member.

15 Claims, 1 Drawing Sheet

FLUID BALL APPLICATOR WITH VENT TUBE

BACKGROUND OF THE INVENTION

1. Field of the Invention:

This invention relates, in general, to fluid applicators and, specifically, to applicators for applying fluid to a surface.

A large number of different applicators have been devised which apply a fluid, such as water, to a surface as the applicator is moved in contact with and across the surface. In particular, fluid applicators have been employed to apply water to moisten the gummed area or mucilage on postage stamps, envelopes and the like.

Typically, such applicators employ a hollow container containing a fluid. An applicator member is mounted on one end of the container and is used to apply fluid to a surface as it is brought in contact with the surface.

One type of applicator is formed of a porous wick material which draws fluid from the container and applies the fluid to a surface as the applicator is moved across in contact with the surface. Another type of applicator employs a rotatable ball or roller which rotates in the liquid within a container and picks up liquid and applies it to a surface as the surface is moved across the applicator.

Both types of fluid applicators suffer from a defect in that the liquid is dispensed in an uncontrolled manner from the applicator. Excess fluid, such as water, frequently drips from the applicator onto the surface, particularly if the applicator is squeezed hardly against the surface. While certain applicators have been provided with overflow means to direct excess fluid back into the container, such are effective only when the applicator member is positioned above the container. They are not effective in those applicators which are used in a downward extending position in which the applicator held downward below the open end of the container to apply fluid to a surface.

Thus, it would be desirable to provide a fluid applicator which overcomes the problems encountered with previously devised fluid applicators insofar as providing a controlled rate of fluid dispersion. It would also be desirable to provide a fluid applicator which prevents excess amounts of fluid from being applied to a surface. Finally, it would be desirable to provide such a fluid applicator which is of simple construction and has a low manufacturing cost.

SUMMARY OF THE INVENTION

The present invention is a fluid applicator which includes a hollow, fluid container having a collar mounted at an open top end thereof. A base is mounted within the collar and is shaped to conform to the shape of a porous, spherical applicator member rotatably mounted in the collar, with a portion of the applicator member extending outward from the collar. An air intake conduit is centrally mounted in the base and extends inward into the fluid container to transmit air from the pores in the applicator member into the container. Fluid outlets are formed in the base to dispense fluid to the porous applicator as the applicator rotates in the collar for applicator to a surface.

In a preferred embodiment, a plurality of air intake grooves are formed in the surface of the base facing the applicator member and extend radially inward to the air intake conduit. The fluid outlets are interposed between the air intake grooves.

In another embodiment, the collar is threadedly attachable to the container. A releasable cap is releasably attachable to the collar to cover the applicator member when not in use.

Means are provided for rotatably mounting the applicator member in the collar. In a preferred embodiment, the mounting means includes a magnetic member mounted on the base, preferably in the form of an annular ring surrounding the air intake conduit. The applicator member is preferably formed with a porous, resilient outer layer covering a metallic layer, formed of iron powder, disposed over a semiflexible or resilient inner member. The metallic layer in the applicator member is magnetically attracted to the magnetic member mounted on the base so as to be retained within the collar and, yet, is capable of free rotational movement when the applicator member is moved in contact with and across a surface to dispense fluid from the hollow container to the surface at a controlled rate.

The fluid applicator of the present invention overcomes a problem encountered with previously devised fluid applicators which did not dispense fluid at a controlled rate. Air is drawn through the air intake conduit by capillary action and pressure differential into the interior of the container and permits the release of a corresponding volume of fluid through the fluid outlets to the porous applicator member. Thus, the amount of fluid dispensed is related to the amount of air drawn into the container which prevents excess amounts of fluid from being applied to the applicator member which could drip from the applicator or cause too much fluid to be applied to a surface. The simple construction of the fluid applicator of the present invention leads to a low manufacturing cost.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
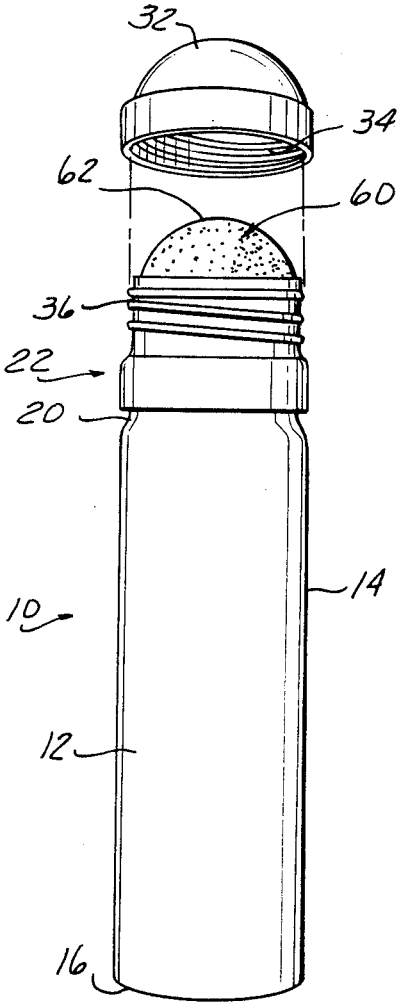
FIG. 1 is a perspective view illustrating the fluid applicator of the present invention.

Throughout the following description and drawing, an identical reference number is used to refer to the same component shown in multiple figures of the drawing.

Referring now to the drawing, and to FIG. 1 in particular, there is illustrated a fluid applicator 10 which is used to apply a thin film of a fluid, such as water, to a surface. Particularly, the fluid applicator 10 is adapted to apply a thin film of water to the gummed portions or mucilage of postage stamps, labels, envelopes and the like.

Figure 2:
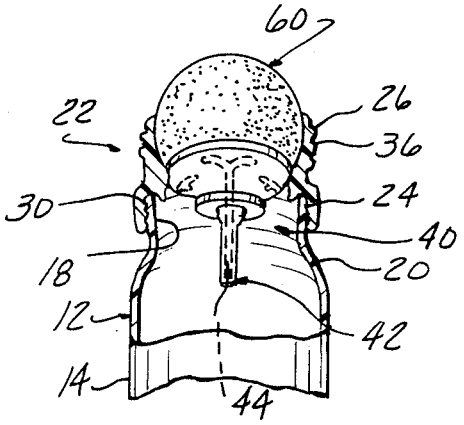
FIG. 2 is an enlarged, partially broken away view showing the construction of the applicator member, collar and upper end of the container of the fluid applicator shown in FIG. 1.

As shown in FIGS. 1 and 2, the fluid applicator 10 includes a hollow container 12 formed of any suitable material, such as glass, plastic, etc. The hollow container 12 is formed with a side wall 14, a closed bottom end 16 and an open top end 18. The side wall 14 is formed with a reduced diameter neck portion 20 adjacent the top end 18.

A collar denoted by reference number 22 is mounted to the top end 18 of the container 12. The collar 22 is preferably formed of a plastic material and has first and second ends 24 and 26, respectively.

While the collar 22 may be mounted in any suitable manner to the open top end 18 of the container 12, in a preferred embodiment, the collar 22 is releasably attached to the container 12 so as to enable the contents of the container 12 to be refilled as necessary. In this embodiment, a plurality of internal threads 28 are formed on the first end 24 of the collar 22. The threads 28 mate with correspondingly formed threads 30 formed on the exterior surface of the neck portion 20 of the container 12. In this manner, the collar 22 may be merely screwed on to the top end 18 of the container 12.

A cap 32 is releasably mountable over the collar 22 for covering the top end of the collar 22. The cap 32 is formed of a suitable material, such as plastic, and has a hollow interior. A plurality of internal threads 34 are formed on the open end of the cap 32 and mate with correspondingly formed external threads 36 formed on the second end 26 of the collar 22.

Figure 3:
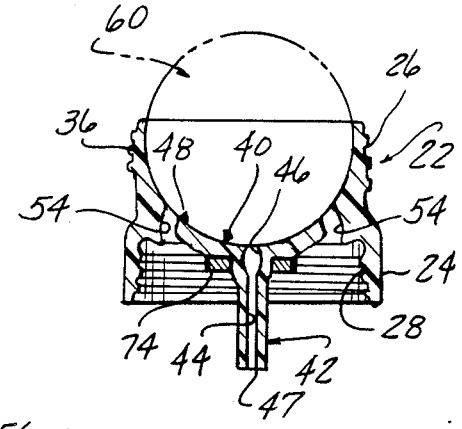
FIG. 3 is a cross sectional view through the applicator member and collar.

A base 40 is positioned internally within the collar 22 between the first and second ends 24 and 26, respectively, of the collar 22. The base 40 has a shape to conform to the shape of an applicator member, described hereafter. In a preferred embodiment, the base 40 has a generally hemispherical shape as shown in FIGS. 2 and 3 and extends in a convex manner inward from the second end 26 of the collar 22. The base 40 is integrally formed in the collar 22 or attached thereto in a suitable manner.

Air intake means 42 is formed on the base 40. The air intake means 42 preferably comprises a thin conduit having a hollow central bore 44 extending therethrough from a first end 46 opening through the base 40 to a second end 47 which opens into the interior of the container 12. The bore 44 has a small cross section so as to draw air through the conduit 42 by capillary action, as described in greater detail hereafter.

Figure 4:
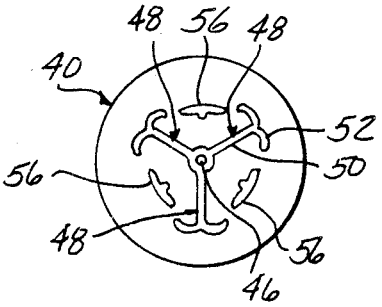
FIG. 4 is a plan view of the base employed in the collar shown in FIG. 3.

As shown in the plan view of FIG. 4, a plurality of radially and circumfrentially extending air intake grooves 48 are formed in the base 40 on the surface facing the applicator member. While each of the air intake grooves 48 may have any desired shape, in a preferred embodiment shown in FIG. 4, each air intake groove 48 is formed with a straight, radially extending section 50 which terminates in two circumfrentially extending, arcuate shaped sections 52. The grooves 48 serve to draw air from the applicator member, as described hereafter, to the first end 46 of the air intake conduit 42.

Figure 5:
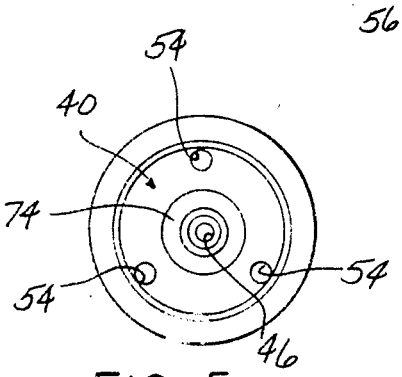
FIG. 5 is a bottom view of the base shown in FIG. 4.

A fluid outlet 54 is also formed in the base 40. Preferably, a plurality of fluid outlets 54 are circumfrentailly spaced about the base 40 interposed between the air intake grooves 48. The fluid outlets 54 generally have a circular cross section at one end, as shown in FIG. 5. The other end of each of the fluid outlets 54 in the base 40 is formed in a generally T-shaped section 56 as shown in FIG. 4 to provide increased surface area to apply fluid from the container 12 to the applicator member.

The fluid outlets 54 are spaced a distance apart from the first end 46 of the air intake conduit 42 to create a slight pressure differential causing air to flow into the conduit 42 in the direction toward the second end 47 and fluid to flow out of the outlets 54 from the container 12.

As shown in FIGS. 1, 2, 3 and 6, the applicator member 60 is in the form of a spherical ball which is rotatably mounted within the collar 22. A portion 62 of the applicator member or ball 60 extends outward from the second end 26 of the collar 22 and is adapted to engage a surface to which fluid from the container 12 is to be applied. Approximately one-half of the applicator member 60 extends outward from the second end 26 of the collar 22 as shown in FIG. 3.

Figure 6:
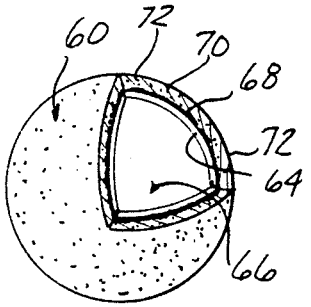
FIG. 6 is a partially broken away view of the applicator member of the present invention.

As shown in FIG. 6, the applicator member 60 is formed with an inner core of either solid construction or, preferably, a thin, semi-flexible or resilient shell 64 surrounding an empty interior cavity 66. A thin metallic layer 68 is formed about the shell 64. Preferably, the metallic layer 68 is formed of powdered iron applied to the surface of the shell 64, the reason for which will be described hereafter.

The outer surface or layer 70 of the applicator member 60 is formed of a semi-porous, soft material, such as a synthetic rubber or plastic. The outer layer 70 includes a plurality of pores 72 which extend from an open end at the outer surface of the applicator member 60 to a closed end in the interior of the outer layer 70. The pores 72 serve to carry fluid from the container 12 as dispensed through the fluid outlets 54 to the surface to which the applicator member 60 is brought into contact. At the same time,the pores 72, after releasing the contained fluid trap air and return the air through the air intake conduit 42 to the interior of the container 12, as described hereafter.

Means are provided for rotatably mounting the applicator member 60 in th collar 22. While any type of rotatably mounting means may be employed, such as by providing a pin extending through the applicator member 60 with its outwardly extending ends mounted in the collar 22, it is preferred that the applicator member 60 be rotatably mounted within the collar 22 for unidirectional movement. In this embodiment, a magnetic member 74 is mounted on the base 40. Preferably, the magnetic member 74, which is formed of magnetizable iron, is in the form of an annular ring surrounding the capillary air intake conduit 42, as shown in FIGS. 3 and 5.

The magnetic member 74 interacts with the metallic layer 68 in the applicator member 60 to magnetically attract the applicator member 60 to the base 40 thereby retaining the applicator member 60 within the collar 22. The primary direction of this magnetic attraction is perpendicular to the plane of the magnetic member 74. At the same time, the strength magnetic field of the magnetic member 74 and the thickness of the metallic layer 68 in the applicator member 60 are chosen to allow rotatable movement, tangential to the plane of the magnetic member 74 to allow unidirectional movement and rotation of the applicator member 60 within the collar 22. Further, the applicator member 60 can be completely removed from the collar 22 for cleaning or replacement under the application of sufficient force.

In assembling the fluid applicator 10 of the present invention, the applicator member 60 and the collar 22 are utilized as a unitary, one piece assembly. The container 12 is initially filled with a suitable fluid, such as water, and the collar 22 threaded onto the open top end 18 of the container 12. The cap 32 is threadingly attached to the collar 22 when the fluid applicator is not in use and is removable to employ the applicator 10 to apply fluid contained within the container 12 to a surface as the applicator member 60 is brought into contact with and urged across the surface.

With the cap 32 removed, the container 12 is inverted such that the applicator member 60 is in a downward position either perpendicular to or at an angle with respect to the surface to which fluid is to applied.

The applicator member 60 is then brought into contact with a surface to be moistened and either the surface or the applicator 10 is urged across each other. As the applicator member rotates within the collar 22, fluid contained within the pores 72 of the applicator member 60 is applied to the surface. After giving up the fluid, the pores 72 trap air and return the air to the air intake grooves 48 in the base 40. The air is drawn through the air intake conduit 42 into the interior of the container 12.

The diameter of the air intake conduit 42 and the cross section or diameter of all of the fluid outlets 54 are selected with a predetermined size such that fluid is dispensed through the outlets 54 in direct proportion to the amount of air drawn in through the air intake conduit 42. The dispensing of fluid through the outlets 54 causes a negative pressure to be formed within the container 12 which draws air into the air intake conduit 42. Fluid is dispersed through the outlets 54 in direct proportion to the amount of air drawn through the air intake circuit 42. Thus, the dispersing of fluid from the container 12 to the applicator member 60 and thence to the surface is controlled. Excess fluid cannot be dispersed from the fluid applicator 10.

In summary, there has been disclosed a unique improved fluid applicator which precisely controls the amount of fluid dispersed from the applicator in proportion to the amount of air drawn into the container. This prevents excess fluid from being applied through the applicator to a surface or prevents dripping of excess fluid from the applicator. The fluid applicator of the present invention is also simplified in construction for a low manufacturing cost.

What is claimed is:

1. A fluid applicator comprising:

a hollow container for containing a fluid, the container having an open top end;

a collar mounted on the open top end of the container, the collar having first and second ends;

a base mounted within the collar and extending across the first end of the collar;

an applicator member rotatably mounted in the collar and extending partially outward from the second end of the collar, the applicator member being formed of a porous material having open ended pores formed on the exterior surface thereof;

fluid dispensing outlets formed in the base in fluid flow communication with the interior of the container to dispense fluid from the container to the applicator member; and a hollow air intake conduit having a first end formed in the base and disposed in fluid flow communication with the pores in the applicator member and a second end disposed within and in fluid flow communication with the interior of the container;

the diameter of the fluid outlets having a predetermined size relative to the diameter of the air intake conduit which causes the amount of fluid dispensed through the fluid outlets to be substantially equal to the amount of air drawn into the air intake conduit.

2. The fluid applicator of claim 1 further including:

means, formed in the collar and the container, for releasably attaching the collar to the container.

3. The fluid applicator of claim 2 wherein the releasable attaching means comprises mating threads formed externally on the open top end of the container and internally on the first end of the collar.

4. The fluid applicator of claim 1 wherein:

the applicator member is in the form of sphere; and the base in the collar is shaped to conform to the shape of the applicator member.

5. The fluid applicator of claim 1 further including:

a cap releasably attachable to the second end of the collar to cover the exposed portion of the applicator member.

6. The fluid applicator of claim 5 wherein mating threads are formed internally on the cap and externally on the second end of the collar to releasbly attach the cap to the collar.

7. The fluid applicator of claim 1 further including:

a plurality of air intake grooves formed in the base facing the applicator member and communicating with the first end of the conduit.

8. The fluid applicator of claim 7 wherein a plurality of fluid outlets are interposed in the base between the air intake grooves.

9. The fluid applicator of claim 1 further including means for rotatably mounting the applicator member in the collar.

10. The fluid applicator of claim 9 wherein the means for rotatably mounting the applicator member in the collar comprises:

a magnetic member mounted on the base; and the applicator member including a metallic material layer magnetically attractable to the magnetic member mounted in the base to hold the applicator member in the collar and allow rotation of the applicator member within the collar.

11. The fluid applicator of claim 10 wherein the magnetic member comprises an annular ring mounted on the base and surrounding the air intake means.

12. The fluid applicator of claim 1 wherein:

the fluid disposed within the interior of the container is a low viscosity fluid.

13. The fluid applicator of claim 1 wherein:

the air intake conduit extends a greater distance into the interior of the container than does the fluid outlets.

14. A fluid applicator comprising:

a hollow container for containing a fluid, the container having an open top end;

a collar mounted on the open top end of the container, the collar having first and second ends;

a hemispherically shaped base mounted within the collar and extending across the first end of the collar;

a spherical applicator member rotatably mounted in the collar and extending partially outward from the second end of the collar, the applicator member being formed of a porous material having open ended pores formed on the exterior surface thereof;

a magnetic member mounted on the base;

the applicator member including a metallic material layer magnetically attractable to the magnetic member mounted in the base to hold the applicator member in the collar and allow rotation of the applicator member within the collar;

fluid dispensing outlets formed in the base in fluid flow communication with the interior of the container to dispense fluid from the container to the applicator member;

a hollow conduit having first and second ends, the first end being attached to the base and disposed in fluid communication through the base with the pores in the applicator member, the second end extending into the container; and a plurality of air intake grooves formed in the base facing the pores of the applicator member and communicating with the first end of the conduit for providing air flow in conjunction with the conduit into the interior of the container;

the diameter of the fluid outlets having a predetermined size relative to the diameter of the air intake conduit which causes the amount of fluid dispensed through the fluid outlets to be substantially equal to the amount of air drawn into the air intake conduit.

15. The fluid applicator to claim 14 further including:

a cap releasably attachable to the second end of the collar to cover the exposed portion of the applicator member.

* * * * *